US008196231B2

(12) United States Patent
Hennessy

(10) Patent No.: US 8,196,231 B2
(45) Date of Patent: Jun. 12, 2012

(54) PRESSURIZED TRAP WATER SAVER TOILET

(75) Inventor: Philip Hennessy, Frankford (CA)

(73) Assignee: P & C Hennessy Holdings, Inc., Frankford, Ontario (CA)

( * ) Notice: Subject to any disclaimer, the term of this patent is extended or adjusted under 35 U.S.C. 154(b) by 1154 days.

(21) Appl. No.: 12/001,338

(22) Filed: Dec. 11, 2007

(65) Prior Publication Data

US 2009/0144889 A1 Jun. 11, 2009

(51) Int. Cl.
*E03D 1/06* (2006.01)

(52) U.S. Cl. ..... 4/328

(58) Field of Classification Search ..... 4/328, 354, 4/362, 363

See application file for complete search history.

(56) References Cited

U.S. PATENT DOCUMENTS 5,142,712 A 9/1992 Hennessy
5,386,596 A 2/1995 Hennessy
5,404,597 A 4/1995 Hennessy
5,406,652 A 4/1995 Hennessy
5,426,794 A 6/1995 Hennessy
5,487,193 A 1/1996 Hennessy
5,666,674 A 9/1997 Hennessy
5,887,293 A 3/1999 Hennessy
5,926,860 A 7/1999 Stauder et al.
6,611,967 B1 9/2003 Hennessy et al.
7,159,251 B2 1/2007 Hennessy
7,299,508 B2 * 11/2007 Li ..... 4/354
8,141,179 B2 * 3/2012 Hennessy ..... 4/328
2011/0289669 A1 * 12/2011 Hennessy ..... 4/328

* cited by examiner

*Primary Examiner* — David Dunn
*Assistant Examiner* — Danielle Jackson
(74) *Attorney, Agent, or Firm* — Leon D. Rosen

(57) ABSTRACT

A toilet that applies pressured air between an upper trap (30) that connects to the toilet bowl and a lower trap (32) that connects to a drain (16), includes a pressured air source (42) that holds a large volume of pressured air equal to at least 30% of the volume of the trapway passage (34) that connects the traps. The pressured air source includes a container (70) with its top coupled though a conduit (90) to the trapway passage, and with air in the container top compressed by water rising in the container after each flushing. The container top lies at least as high as the full water level (52) in the toilet tank when the toilet tank is full.

8 Claims, 3 Drawing Sheets

10
50
40
52
42
22
20
2
2
70
24
90
26
12
14
34
30
16
32

PRESSURIZED TRAP WATER SAVER TOILET

BACKGROUND OF THE INVENTION

My earlier U.S. Pat. No. 7,159,251, describes a water saver toilet that maintains pressured air in a trapway passage that extends between upper and lower traps that are respectively connected to the toilet bowl and to a drain. The pressured air that is present between flushes, pushes water from the upper trap into the toilet bowl to maintain a larger spot of water in the toilet bowl, and uses the sudden drop of trapway air pressure during a flushing to enhance the flushing.

Applicant has found that a toilet of the type described in the above patent, occasionally loses all water in the upper trap. A thorough investigation shows that sometimes when someone applies a small amount of fluid or solid to the toilet bowl, as by urinating, and does not flush it, that small amounts of water flow out through the upper and lower traps along with some of the pressured air, without replenishment of the pressured air as would occur during a flushing. Such an event can result in the loss of substantially all air pressure in the trapway passage and in water in the upper trap siphoning out. The absence of water allows sewer gas to enter the bathroom. A way to prevent such inadvertent loss of air pressure and consequent siphoning, would be of value.

SUMMARY OF THE INVENTION

In accordance with one embodiment of the present invention, a toilet is provided of the type that includes a pressured trapway passage, which resists the inadvertent loss of air pressure between flushings. The toilet includes a pressure-generating container lying in the toilet tank for generating a quantity of pressured air after each flushing. The container has a closed top so when water flows into the container during a tank refill following each flushing, air in the container is compressed. The closed top of the container preferably lies above the highest tank water level, so a lot of pressured air is available to maintain the initial air pressure in the trapway even if some of the pressured air in the trapway passage is inadvertently lost. The air-containing volume in the container, is at least 30% and preferably at least 50% of the trapway passage volume.

The tank is connected to an isolator that isolates most water used in each flushing, through a hole of limited cross-section. This assures only a slow flow of water into the isolator near the end of a flushing. The size (cross-sectional area) of the hole has a large effect in determining whether or not there is a good flushing. Applicant allows easy adjustment of the size of the hole by allowing plug(s) (each with a hole of predetermined size) to be inserted into the hole or removed to adjust the flushing.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
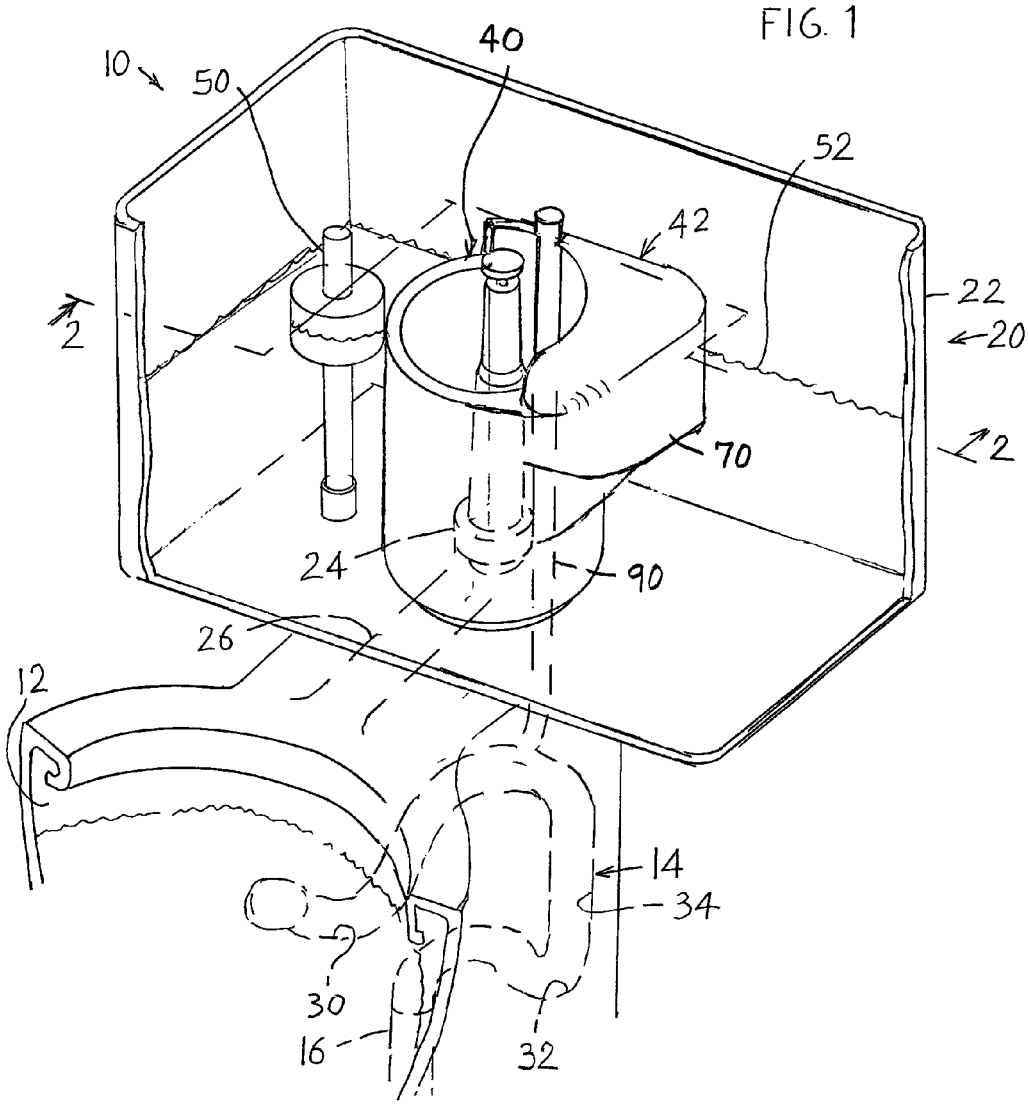
FIG. 1 is a partial isometric view of a toilet of the present invention with part of the toilet tank cut away.

FIG. 1 shows a toilet 10 of the present invention, which includes a pottery section comprising a toilet bowl 12 and a trapway 14 that leads from the toilet bowl to a drain 16. A water source 20 includes a water tank 22 and a flush valve 24 that discharges water that has been stored within an isolator 40 that lies in the tank. Discharged water flows though a water tunnel 26 and though openings at the top of the toilet bowl, into the toilet bowl during a flushing. The trapway includes upper and lower traps 30, 32 and a trapway passage 34 that extends between them. The water source 20 includes the isolator 40 and a container 42 that both lie in the tank 22, and that are part of a single structure. A refill valve 50 admits water into the tank after each flushing, until the water level in the tank reaches a tank full level 52. The flush valve 24 lies in the bottom of the isolator 40 which lies within the tank, so most of the water dispensed through the flush valve in each flushing is water that has laid in the isolator.

Figure 2:
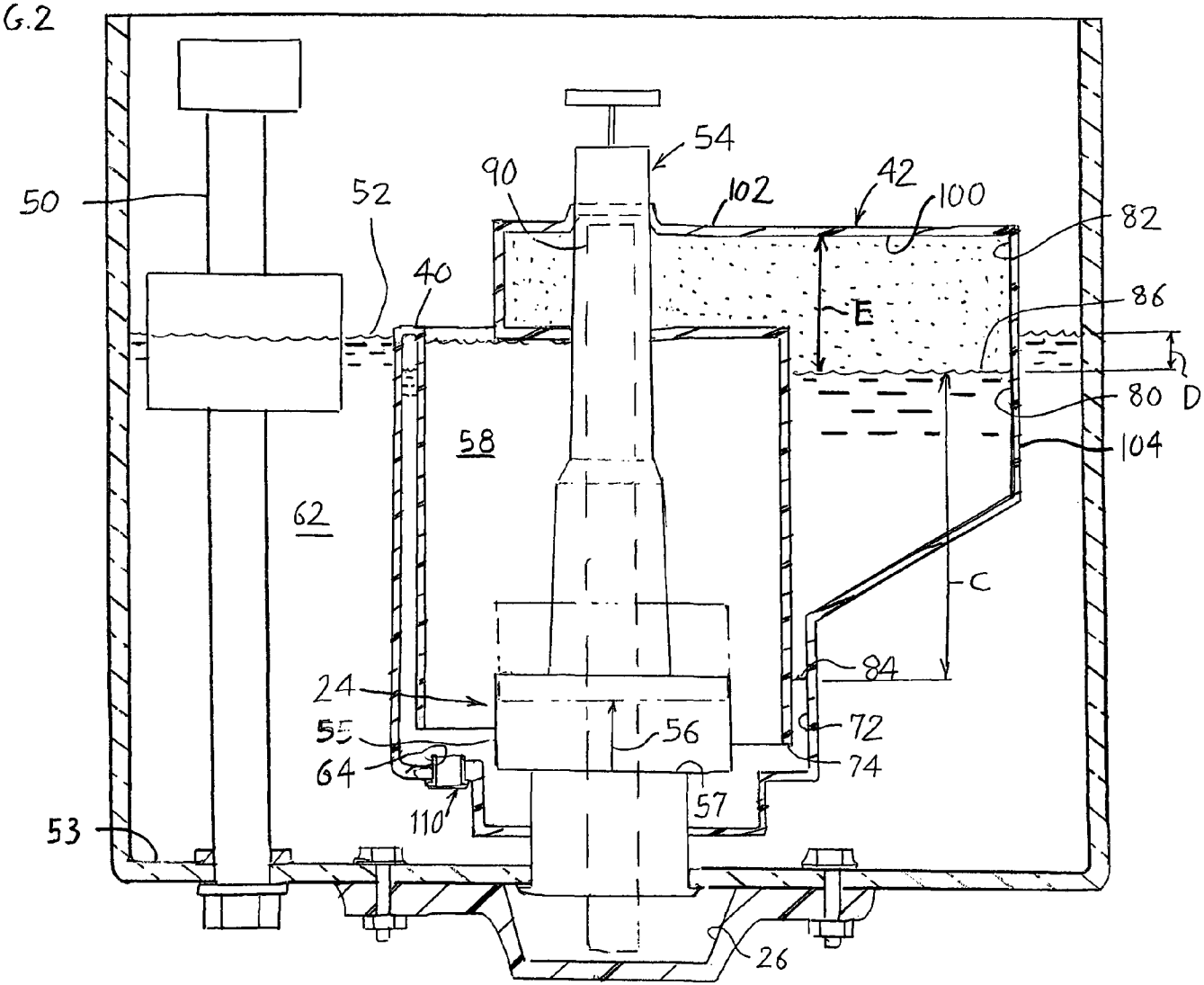
FIG. 2 is a sectional front view of the upper portion of the toilet of FIG. 1, taken on line 2-2 of FIG. 1.

FIG. 2 shows that the flush valve 24 includes a mechanism 54 that is operated to raise a flush valve member 55, as indicated by arrow 56, off a flush valve seat 57. When the flush valve member is raised, it floats above the valve seat until the water level in the isolator falls to a low level, and then closes. Most of the water released in each flushing is a main flush quantity 58 that lies in the isolator around the flush valve 24. The isolator 40 preferably extends above most of the tank full level 52. Some of the flush water is water from the surrounding tank region 62 that passes into the isolator though a tank-isolator hole 64 which lowers the level of water in the surrounding tank region 62. Additional water comes through a passage 72 from the container 42 that generates air pressure and a vacuum in its upper portion. The passage 72 preferably extends more than 180° around the flush valve, with the passage 72 actually extending completely around the isolator 40. As a result, the water level 86 drops rapidly at the beginning of a flushing, and yet the passage 72 is narrow to assure that water does not flow completely out the bottom 74 of the passage before the flush valve closes. The cross-section of the container at the passage level 84 (as seen in a downward view) is less than half the cross-section at the upper cavity portion at level 86. After each flushing, the refill valve 50 refills the tank, and the level of water in the isolator and in the container are restored to their original levels.

The container 42 serves as a pressured air source between flushings and serves as a vacuum source during an early stage of each flushing. The container 42 has a cavity 80 with an upper portion 82 that stores pressured air prior to each flushing. During each refill of tank water, when the water level rises from the passage level 84 to water level 86, air in the container upper portion 82 becomes compressed. A typical pressure is 1.5 centimeters of water (the pressure at the bottom of a column of water 1.5 cm high), which is about 0.02 psi. A conduit 90 connects the upper portion of the cavity to the trapway passage that extends between the upper and lower traps.

Figure 3:
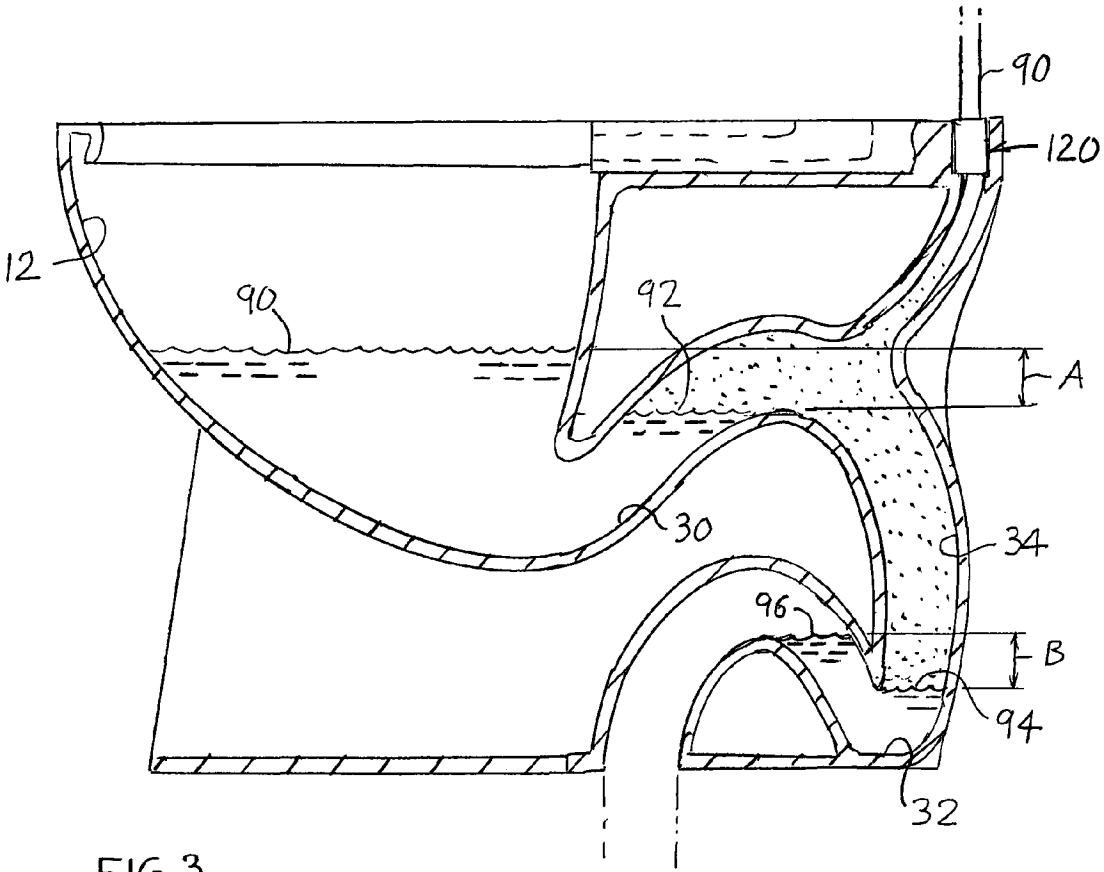
FIG. 3 is a sectional view of the lower portion of the toilet of FIG. 1, shown prior to a flushing.

FIG. 3 shows the trapway passage 34 that extends between the upper and lower traps 30, 32, before a flushing when the trapway passage contains pressured air. The pressured air raises the level of water in the toilet bowl 12, to create a water spot 90 of increased area and to increase the volume of water in the toilet bowl. The top of the water spot lies a distance A above the level of water 92 at the downstream end of the upper trap, where the distance A is equal (within 5 mm) to the air pressure in centimeters of water in the trapway passage. The level 94 in the upstream end of the lower trap 32 lies a distance B below the level of water 96 in the downstream end of the lower trap, where B is equal to A.

As mentioned above, applicant has found that occasionally all water leaves the toilet bowl. Applicant believes this is due to adding moderate amounts of material to the toilet bowl, as by a person urinating at night and not flushing. Such additions initially cause a small amount of water to flow down to the lower trap and cause some of the pressured air to bubble though the lower trap, thereby reducing air pressure in the trapway passage 34 and lowering the level of water in the toilet bowl. A further addition of material can cause all water in the upper trap to siphon out, and cause all water in the toilet bowl to siphon out. Such "mysterious" loss of water in the toilet bowl resulting from loss of air pressure in the trapway, can be avoided by increasing the volume of pressured air connected to the trapway so a loss of a small amount of pressured air does not significantly reduce air pressure.

FIG. 2 shows how applicant obtains a large volume of pressured air that is connected through the conduit 90 to the trapway passage. The tank full level 52 of water in the tank is about 20 centimeters above the bottom 53 of the tank. Early during each flushing the level of water in the container rapidly drops, from 86 to nearly 84, and a vacuum fills the container down to about the level 84. The vacuum is applied through conduit 90 to the trapway passage 34 (FIG. 3) to help draw the contents of the toilet bowl into the trapway passage. After the beginning of a flushing, the water level in the container 42 (FIG. 2) rises towards the container fill level 86. Water rises by a height C of about 10 centimeters and tends to pressurize air in the container upper portion to a pressure of about 3 centimeters of water. Toward the end of a flushing any air pressure in excess of about 1.5 centimeters of water (0.02 psi) escapes though the conduit 90 and the lower trap, until the pressure in the container upper portion 82 falls to the desired level of about 1.5 cm. of water.

Applicant obtains a large volume of pressured air in the container upper portion 82, by locating the top 100 of the container cavity upper portion above the tank full height 52 and preferably at least one centimeter above the tank fill height. Water fills the container to the level 86 which lies a distance D below the tank full height 52, where D is equal (within 5 mm) to the heights A and B of the traps, and is about 1.5 centimeters. The large height E of the container cavity top above the container fill level 86 allows a large volume of pressured air to be stored. Applicant prefers that the volume of water in the container between levels 86 and 84 be at least as great as the volume of the trapway passage to apply a significant vacuum at the beginning of a flushing.

The trapway passage 34 (FIG. 3) and conduit of the illustrated toilet have a combined volume of 750 milliliters (750 cubic centimeters). In a prior toilet that application made and tested, which had the problems of sudden emptying of the toilet bowl, applicant stored a volume of pressured air of about 150 milliliters at the top of the container and in the conduit, or about 20% of the volume of the trapway passage 34 and conduit. The container 42 of FIG. 2 stores about 500 ml of pressured air, which is about 67% of the trapway volume. Applicant found that the toilet of FIG. 2 did not have the problem of sudden emptying of the toilet bowl when about 250 ml of water was dumped into the toilet bowl to simulate a person urinating. Applicant stores a volume of pressured air in the container of at least 30% of the trapway passage plus conduit volume, and prefers to store a volume of at least 50% of trapway passage plus conduit volume in the container. The height of the container cavity top must lie above the height 86 of the container fill level, and preferably lies above the tank full waterline 52.

A flushing of the toilet bowl may last several seconds. During the first two or so seconds, there is a large flow rate of water from within the isolator through the flush valve, and the large flow causes water and debris in the toilet bowl to be siphoned out. This is initially aided by a vacuum in the trapway. Then the flow rate suddenly slows as the height of water in the isolator drops to a low level, but water continues to flow into the isolator though the restricted container passage 72 and from the tank though the tank-isolator hole 64 and fills the traps. Finally, the flush valve member 52 seats on the valve seat and water flow stops. It is important to slowly flow sufficient water though the tank-isolator hole 64 near the end of the flushing to fill the traps. An excessive flow near the end of a flushing wastes water. Applicant constructs the tank-isolator hole 64 so its diameter (cross-section) can be easily varied by the manufacturer, or by a plumber or homeowner. Applicant provides a plug 110 with a large hole. If insufficient water is filling the traps before the flush valve member closes, then the plug can be removed to increase the flow of water near the end of a flushing. If too much water flows, a plug with a smaller hole can be substituted.

As mentioned above, air flows down into the trapway 34 (FIG. 3) near the end of each flushing to maintain a pressure therein (e.g. of about 1.5 cm water) between flushings. Also, air flows up out of the trapway early during a flushing which create a vacuum therein. Air must be allowed to flow freely via the conduit 90, but waste from the toilet bowl must be kept out of the conduit 90 so it does not clot the conduit and so it does not enter the container 42 and clog it. If the toilet plunger is used to pressurize water and waste in the toilet bowl in an attempt to clear a blockage, it would be possible for some waste to be pushed up through the conduit 90 into the container. To prevent this, applicant provides a backflow preventor 120.

Figure 4:
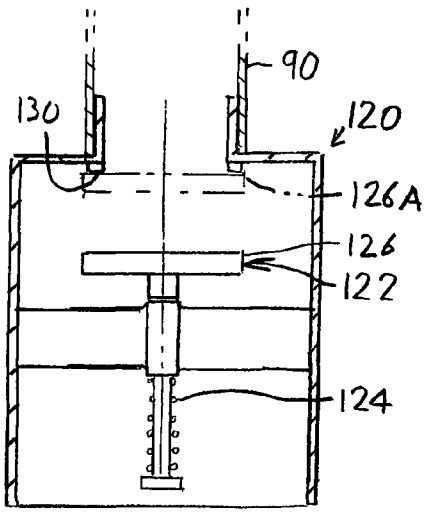
FIG. 4 is a sectional view of a backflow preventor of the toilet of FIG. 3.

During normal toilet operation there is only a low pressure of water in the trapway passage 34. However, if the pressure increases to much above the pressure (of about 10 cm of water) that is encountered during a normal flushing, as when a toilet plunger is used, then the backflow preventor 120 prevents the forceful upflow of water and waste along the conduit 90 into the container 42. A variety of valve mechanisms can be used for the backflow preventor. FIG. 4 shows one valve mechanism which includes a plunger 122 that is biased downward by a compression spring 124 so the plunger head 126 lies below a valve seat 130. When a large upward pressure (e.g. over 20 cm or 50 cm of water) is applied to the plunger head, the plunger head moves up to 126A against the valve seat 130 and the valve closes.

Thus, the invention provides a water saver toilet with a container that stores a quantity of pressured air at the end of each flushing, with the pressured air connected to a trapway passage that lies between upper and lower traps. The pressure turns into a vacuum at the beginning of a flushing and later back to a pressure to enhance each flushing. Applicant avoids sudden emptying of the toilet bowl by increasing the volume of pressured air stored prior to each flushing. This is accomplished by placing the top of the container cavity higher than the tank full level, and preferably more than a centimeter above the tank full level. A tank-isolator hole includes a removable plug with a hole through it that enables the diameter of the hole to be varied to assure that the traps are filled at the end of each flushing, but that a minimum of water is used in each flushing.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A toilet which includes a toilet bowl, a trapway with an upper trap that connects to said toilet bowl and a lower trap that connects to a drain and a trapway passage that extends between said traps, a tank, a water supply in said tank that flows water into said toilet bowl in each flushing, and a source of pressured air coupled to said trapway passage to establish a positive air pressure that is at a pressure on the order of magnitude of 1.5 centimeters of water above atmospheric pressure, in said trapway passage prior to a flushing, said trapway passage and a conduit that extends from said source to said trapway passage having a combined volume on the order of magnitude of 750 ml, prior to a flushing, wherein:

said source of pressured air is constructed to supply pressured air at a pressure on the order of magnitude of 1.5 centimeters of water above atmospheric pressure that fills said trapway passage and conduit, and to store an additional volume of said pressured air equal to at least 30% of the volume of said trapway passage and conduit prior to each flushing, to thereby maintain a positive trapway passage air pressure prior to a flushing despite a slight change in water volume in said traps.

2. The toilet described in claim 1 including a refill valve that refills the tank to a predetermined tank full level after each flushing, and wherein:

said source of pressured air includes a container that lies in said tank and that has a cavity with a cavity lower end that is coupled to a lower end of said tank to flow water into and out of the container, and that has a cavity upper end for holding pressured air, said source of pressured air also including said conduit that extends from said container upper end to said trapway passage to carry air between them;

the vertical distance C by which water rises in the cavity between a lower level (84) that occurs during a flushing and a full level (86) after a flushing, is sufficient to produce a pressure of at least 1.5 centimeters of water in said cavity upper end.

3. The toilet described in claim 1 wherein:

between flushings water in said container lies at a predetermined fill level (86), and during each flushing water in the container drops to a predetermined low container level (84);

the volume within said container between said fill level and said low container level is at least as great as the volume of said trapway passage between said upper and lower trap.

4. The toilet described in claim 1 including:

a structure that lies in said tank and that forms an isolator that isolates an isolator region within the isolator from a tank region that lies around the isolator, said isolator including a tank-isolator hole that connects lower portions of the tank and of the isolator;

said tank-isolator hole being changeable in hole size.

5. A toilet which includes a toilet bowl (12), a trapway with an upper trap (30) that connects to said toilet bowl and a lower trap (32) that connects to a drain and a trapway passage (34) extending between the traps, with said traps each constructed to block the passage of air through the trap when sufficient water has been introduced into the trap, said toilet including a tank, a fill valve (50) in said tank that flows water into said tank at each flushing until a predetermined tank full level (52) is reached, and a flush valve (24) that releases water into said toilet bowl in each flushing, comprising:

means for maintaining an air pressure above atmospheric in said trapway passage between flushing, and for applying a vacuum to said trapway passage at the beginning of each flushing, including a container (42) that lies in said tank, that has a container upper part (82) connected through a conduit (90) to said trapway passage and that has a container bottom portion (74) that is coupled to said tank to receive water therefrom to pressurize air in said container upper part, said container being constructed to generate pressurized air in a sufficient volume in said container upper part to maintain said air pressure above atmospheric in said trapway passage between flushings;

said sufficient volume of pressured air is at least 30% of the trapway passage.

6. The toilet described in claim 5 including:

a conduit (90) that extends between said container top and said trapway passage; and a backflow preventor that lies along said conduit and that closes to prevent the upward passage of water along the conduit when there is a sudden large increase of fluid pressure in the trapway passage as a result of a person using a plunger to force water out of the toilet bowl.

7. A toilet which includes a toilet bowl, a trapway with an upper trap (30) that connects to said toilet bowl and a lower trap (32) that connects to a drain and a trapway passage (34) extending between the traps, a tank (22), and a fill valve (50) in said tank that flows water into said tank at each flushing until a predetermined tank full level (52) is reached, comprising:

a source of pressured air (42) coupled to said trapway to establish a positive air pressure that is above atmospheric pressure in said trapway passage prior to a flushing, said source of pressured air comprising a container (70) with a lower cavity portion and a coupling (64) coupled to said tank to receive and dispense water in each flushing and with an upper cavity portion (82) with an upper end (100), said upper cavity portion coupled to said trapway passage through a conduit (90) to supply pressured air thereto, wherein:

said conduit (90) has a top that lies at a level that is higher than said tank full level (52).

8. The toilet described in claim 7 including a flush valve that lies between said tank and said toilet bowl, and wherein:

said container forms an isolator (40) lower cavity portion (84) has a cross-section as seen in a downward view, that is less than half the cavity cross-section of said upper cavity portion (82) as seen in a downward view, with at least said lower cavity portion extending more than 180° around said flush valve.

* * * * *